US008991180B2

(12) United States Patent
Rewers et al.

(10) Patent No.: US 8,991,180 B2
(45) Date of Patent: Mar. 31, 2015

(54) DEVICE AND METHOD FOR THE RECOVERY OF WASTE HEAT FROM AN INTERNAL COMBUSTION ENGINE

(75) Inventors: Gregory Rewers, Schwieberdingen (DE); Nadja Eisenmenger, Stuttgart (DE); Achim Brenk, Kaempfelbach (DE); Dieter Seher, Ilsfeld (DE); Hans-Christoph Magel, Reutlingen (DE); Andreas Wengert, Auenwald (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/879,474

(22) PCT Filed: Sep. 7, 2011

(86) PCT No.: PCT/EP2011/065465

§ 371 (c)(1), (2), (4) Date: Jun. 24, 2013

(87) PCT Pub. No.: WO2012/048958

PCT Pub. Date: Apr. 19, 2012

(65) Prior Publication Data

US 2013/0283790 A1 Oct. 31, 2013

(30) Foreign Application Priority Data

Oct. 13, 2010 (DE) ..... 10 2010 042 405

(51) Int. Cl.

| | |
|---|---|
| ***F01K 23/10*** | (2006.01) |
| ***F01K 13/02*** | (2006.01) |
| ***F01K 21/06*** | (2006.01) |
| ***F01N 5/02*** | (2006.01) |
| ***F01K 3/22*** | (2006.01) |

(52) U.S. Cl.

CPC ... *F01N 5/02* (2013.01); *F01K 3/22* (2013.01); *F01K 13/02* (2013.01)

USPC ..... 60/618; 60/646

(58) Field of Classification Search

USPC ..... 60/614–624, 645–681

See application file for complete search history.

(56) References Cited

U.S. PATENT DOCUMENTS

| | | | | |
|---|---|---|---|---|
| 6,751,959 | B1 * | 6/2004 | McClanahan et al. | 60/670 |
| 2009/0071156 | A1 * | 3/2009 | Nishikawa et al. | 60/660 |
| 2009/0229786 | A1 | 9/2009 | Freyman et al. | |
| 2011/0203278 | A1 * | 8/2011 | Kopecek et al. | 60/660 |

FOREIGN PATENT DOCUMENTS

| | | |
|---|---|---|
| CN | 101243243 | 8/2008 |
| DE | 102006040857 | 3/2008 |
| DE | 102006043835 | 3/2008 |
| DE | 102006057247 | 6/2008 |
| DE | 102007008609 | 8/2008 |
| DE | 102008013545 | 9/2009 |

* cited by examiner

*Primary Examiner* — Christopher Jetton

(74) *Attorney, Agent, or Firm* — Michael Best & Friedrich LLP

(57) ABSTRACT

The invention relates to a device and a method for the recovery of waste heat from an internal combustion engine (2), according to which a feed pump (6), a heat exchanger (8), an expansion engine (10) and a capacitor (12) are arranged in a circuit (4) containing a circulating working medium. A bypass connection (14) is mounted in parallel to the expansion engine (10), in the circuit (4), the expansion engine (10) being coupled to the circuit (4), or decoupled therefrom, according to an operating situation of the internal combustion engine (2).

21 Claims, 2 Drawing Sheets

DEVICE AND METHOD FOR THE RECOVERY OF WASTE HEAT FROM AN INTERNAL COMBUSTION ENGINE

BACKGROUND OF THE INVENTION

The invention relates to a device and a method for waste-heat utilization.

DE 10 2006 057 247 A1 has already disclosed a supercharging device which serves for utilizing the waste heat of an internal combustion engine. At least one heat exchanger of a circuit of a working medium is accommodated in the exhaust tract of the internal combustion engine. A turbine part and a delivery assembly are also arranged in the circuit. A compressor part arranged in the intake tract of the internal combustion engine is driven by means of the turbine part.

SUMMARY OF THE INVENTION

The device according to the invention for utilizing the waste heat of an internal combustion engine and the associated method according to the invention having the features of the independent claims has the advantage that vaporous working medium is conducted past the expansion machine through a bypass connection which is connected in parallel with the expansion machine. As a result of the control by means of a bypass pressure regulating valve, it is possible to manipulate the thermodynamic process for waste-heat utilization in a targeted manner. Depending on an operating situation of the internal combustion engine, the expansion machine can be coupled into or decoupled from a line circuit. If there is no load demand on the expansion machine, the steam can be conducted past the expansion machine.

It is advantageous for a bypass pressure regulating valve and/or a pressure limiting valve to be arranged in the bypass connection because, by means of said regulating elements, the steam can be controlled so as to be conducted past the expansion machine as required. The pressure limiting valve is opened when a predefined pressure is exceeded and can thus protect components in the line circuit and the expansion machine against destruction by excess pressure. The bypass pressure regulating valve may supply steam to the expansion machine or conduct said steam past the expansion machine as a function of the respective load demands.

A pressure regulating valve in a line between the feed pump and heat exchanger is advantageous because the pressure level for the evaporation and thus the evaporation temperature are adjusted by means of the pressure regulating valve. Alternatively or in addition, a pressure relief valve may also be provided. Here, only a single pressure level can be set, but lower costs are incurred for acquisition and regulation.

It is advantageous for the condenser to be connected to a cooling circuit of the internal combustion engine. Heat from the heat exchanger can be dissipated via the bypass connection and the condenser to the cooling circuit of the internal combustion engine. Said energy may be utilized, before the start-up of the expansion machine, for a faster warm-up of the internal combustion engine.

It is particularly advantageous for at least one line of the bypass connection to run through a housing or in the vicinity of the housing of the expansion machine. If ice or residues are situated in the expansion machine as a result of a frozen working medium, it is possible by means of the opening of the bypass pressure regulating valve for heated steam to be conducted through the housing or conducted past in the vicinity of the housing of the expansion machine. The ice and residues are removed by means of the heated steam and damage upon start-up of the expansion machine is avoided.

If the internal combustion engine is being operated at reduced power or the load demand on the internal combustion engine is briefly reduced, it is advantageous for the working medium to flow through the bypass connection as a result of the opening of the bypass pressure regulating valve, and for the power output of the expansion machine to thus be reduced. As a result of the simultaneous power reduction of the internal combustion engine and expansion machine, it is possible to prevent mechanical energy, for which there is no consumer, from being produced with a certain time delay owing to the thermodynamic inertia.

It is advantageous for pressure pulsations and pressure oscillations in the heat exchanger and/or in the adjoining lines to be reduced by means of a cyclic opening of the bypass pressure regulating valve, because no costs are incurred for further components for preventing pressure oscillations.

To protect the expansion machine against damage by water droplets generated during the condensation of inadequately superheated steam, the bypass pressure regulating valve may be opened in the event of excessively low quality of the steam, such that the steam is conducted past the expansion machine.

BRIEF DESCRIPTION OF THE DRAWINGS

Exemplary embodiments of the invention are illustrated in the drawing and will be explained in more detail in the following description, in which.

DETAILED DESCRIPTION

Figure 1:
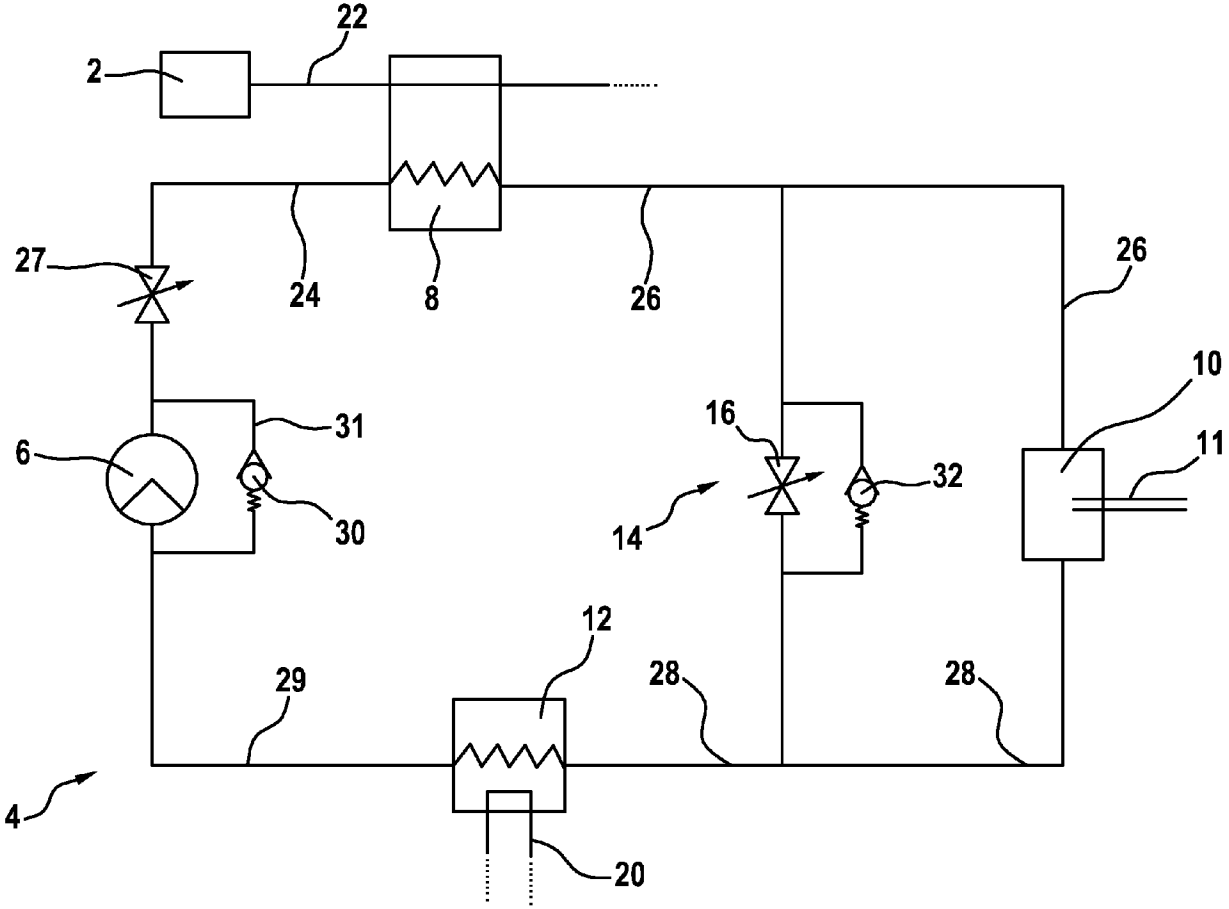
FIG. 1 is a schematic illustration of a device for waste-heat utilization according to a first exemplary embodiment.
Figure 2:
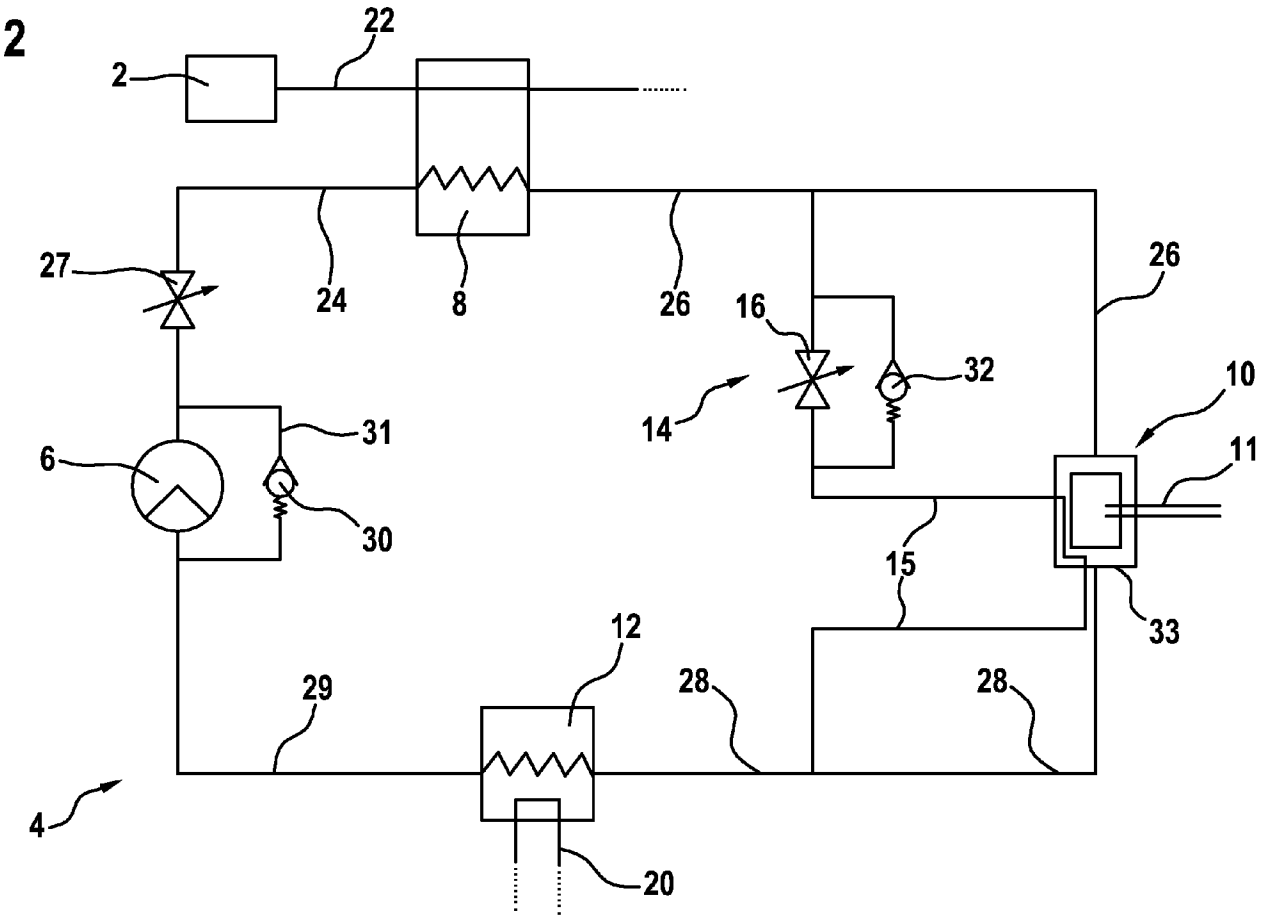
FIG. 2 is a schematic illustration of a device for waste-heat utilization according to a second exemplary embodiment.

FIGS. 1 and 2 show a device for utilizing the waste heat of an internal combustion engine 2, having a line circuit 4, in which a working medium circulates. At least one heat exchanger 8, an expansion machine 10, a condenser 12 and a feed pump 6 are arranged in the line circuit 4.

The internal combustion engine 2 may in particular be in the form of an air-compressing, auto-ignition or mixture-compressing, applied-ignition internal combustion engine 2. The device for waste-heat utilization is suitable in particular for applications in motor vehicles. The device according to the invention for waste-heat utilization is however also suitable for other applications.

The internal combustion engine 2 burns fuel in order to generate mechanical energy. The exhaust gases generated in the process are discharged via an exhaust system in which an exhaust-gas catalytic converter may be arranged. A line portion 22 of the exhaust system leads through a heat exchanger 8. Heat energy from the exhaust gases or from the exhaust-gas recirculation arrangement is dissipated via the line portion 22 in the heat exchanger 8 to the working medium, such that the working medium can be evaporated and superheated in the heat exchanger 8.

The heat exchanger 8 of the line circuit 4 is connected via a line 26 to the expansion machine 10. The expansion machine 10 may be in the form of a turbine or piston machine. The evaporated working medium flows via the line 26 to the expansion machine 10 and drives the latter. The expansion machine 10 has a drive shaft 11 via which the expansion machine 10 is connected to a load. In this way, mechanical energy may for example be transmitted to a drivetrain or serve for driving an electrical generator, a pump or the like. After flowing through the expansion machine 10, the working medium is conducted via a line 28 to a condenser 12. The working medium which is expanded by means of the expansion machine 10 is cooled in the condenser 12. The condenser 12 may be connected to a cooling circuit 20. Said cooling circuit 20 may for example be a cooling circuit of the internal combustion engine 2. The working medium liquefied in the condenser 12 is transported via the line 29 into the line 24 by a feed pump 6.

In the line 24 there is situated a pressure regulating valve 27 which serves for regulating the pressure of the working medium in the inlet to the heat exchanger 8. The evaporation temperature of the working medium can be regulated by means of the predefined pressure in the inlet to the heat exchanger 8. Furthermore, a bypass connection 31 may be provided in parallel with the feed pump 6, in which bypass connection is situated a pressure relief valve 30. The maximum admissible pressure of the working medium between the feed pump 6 and heat exchanger 8 can be set by means of the pressure relief valve 30.

The line 24 leads directly into the heat exchanger 8, in which the working medium is evaporated and if appropriate superheated. The evaporated working medium passes to the expansion machine 10 again via the line 26, and the working medium flows again through the line circuit 4. A flow direction of the working medium through the line circuit 4 is defined by the feed pump 6 and the expansion machine 10. It is thus possible for heat energy to be extracted continuously from the exhaust gases and the constituent parts of the exhaust-gas recirculation arrangement of the internal combustion engine 2 by means of the heat exchanger 8, which heat energy is released in the form of mechanical energy to the shaft 11.

As working medium, use may be made of water or some other liquid which meets the thermodynamic requirements. As it flows through the line circuit 4, the working medium undergoes thermodynamic changes in state. In the liquid phase, the working medium is raised to the pressure level for the evaporation by the feed pump 6. The heat energy of the exhaust gas is subsequently dissipated to the working medium by means of the heat exchanger 8. Here, the working medium is evaporated isobarically and subsequently superheated. The steam is subsequently expanded adiabatically in the expansion machine 10. Here, mechanical energy is gained and transmitted to the shaft 11. The working medium is then cooled in the condenser 12 and supplied to the feed pump 6 again.

In the line circuit 4, there is situated a bypass connection 14 which is connected in parallel with the expansion machine 10. The bypass connection 14 produces a connection between the line 26 between the heat exchanger 8 and expansion machine 10 and the line 28 between the expansion machine 10 and condenser 12. In the bypass connection 14 there is arranged a further bypass pressure regulating valve 16. Instead of the further bypass pressure regulating valve 16, a pressure limiting valve 32 may be situated in the bypass connection 14. A parallel connection of the bypass pressure regulating valve 16 and the pressure limiting valve 32 in the bypass connection 14 is also possible.

By means of the opening of the bypass pressure regulating valve 16 or of the pressure limiting valve 32, it is possible for the working medium to flow directly from the heat exchanger 8 to the condenser 12 and to be conducted past the expansion machine 10.

The pressure limiting valve 32 may be set to a maximum pressure, upon the exceedance of which it opens and allows the working medium to flow through the bypass connection. Said maximum pressure should be adapted to the configuration of the system and prevent an excess pressure in the line circuit 4. By virtue of the pressure limiting valve 32 being opened in good time, damage to components in the line 26 and to the expansion machine 10 can be prevented.

By means of a targeted opening of the bypass pressure regulating valve 16, the power of the expansion machine can be reduced in parallel with the power of the internal combustion engine 2. If there is no load demand on the expansion machine, the steam can be conducted past the expansion machine 10 in a targeted manner by means of the opening of the bypass pressure regulating valve 16.

Furthermore, the bypass pressure regulating valve 16 may serve for reducing pressure oscillations that may arise in the heat exchanger 8 and the adjoining lines 24, 26. By means of a brief, cyclic opening and closing of the bypass pressure regulating valve 16, the pressure oscillations can be reduced and damped.

If the internal combustion engine 2 is started at low ambient temperatures, the heat absorbed in the heat exchanger 8 from the exhaust gas or the exhaust-gas recirculation arrangement can be conducted directly via the bypass connection 14 to the condenser 12. As a result of the opening of the bypass pressure regulating valve 16, the heated steam flows past the expansion machine 10 and is conducted directly to the condenser 12, which can transfer the thermal energy directly to the cooling circuit 20 of the vehicle. Since no expansion of the working medium in the expansion machine 10 has taken place, a particularly large amount of energy is available for the fast warm-up of the internal combustion engine 2.

If insufficient superheating of the steam takes place in the heat exchanger 8 owing to an excessively low availability of heat from the exhaust system, the steam has a low quality. In this case, there is the risk of droplets forming in the expansion machine 10 owing to condensation during the expansion of the steam. Said droplets may lead to damage in the expansion machine 10. To protect the expansion machine against said damage by condensation, the bypass pressure regulating valve 16 may be opened in the event of low quality of the steam, such that the steam is conducted past the expansion machine 10.

A further exemplary embodiment is illustrated in FIG. 2, in which a line portion 15 of the bypass connection 14 situated downstream of the bypass pressure regulating valve 16 or the pressure limiting valve 32 is conducted through a housing 33 of the expansion machine 10. Alternatively, said line portion 15 of the bypass connection 14 situated downstream of the bypass pressure regulating valve 16 or the pressure limiting valve 32 may also be conducted past the expansion machine 10 in the vicinity of the housing 33.

By means of the exemplary embodiment shown in FIG. 2, at temperatures below the freezing point or close to the freezing point of the working medium, before the start-up of the expansion machine 10, steam heated in the heat exchanger 8 can be conducted through the housing 33 of the expansion machine 10, or conducted past in the vicinity of the housing 33 of the expansion machine 10, by means of the opening of the bypass pressure regulating valve 16. Ice or frozen residues in the expansion machine 10 can be dissolved by the heated steam.

The invention claimed is:

1. A device for utilizing the waste heat of an internal combustion engine (2), having a line circuit (4) in which are arranged a feed pump (6), at least one heat exchanger (8), an expansion machine (10), and a condenser (12), wherein a working medium circulates in the line circuit (4), characterized in that a bypass connection (14) is connected in parallel with the expansion machine (10), in such a way that, as a function of an operating situation of the internal combustion engine (2), the expansion machine (10) is coupled into or decoupled from the line circuit (4) for waste-heat utilization, wherein both a bypass pressure regulating valve (16) and a pressure limiting valve (32) are arranged in parallel in the bypass connection (14).

2. The device as claimed in claim 1, further comprising at least one of a pressure regulating valve and a pressure relief valve for adjusting the pressure in a line (24) between the feed pump (6) and heat exchanger (8).

3. The device as claimed in claim 1, characterized in that the condenser (12) is connected to a cooling circuit (20) of the internal combustion engine (2).

4. The device as claimed in claim 1, characterized in that at least one line of the bypass connection (14) runs through a housing (33) or in the vicinity of the housing (33) of the expansion machine (10).

5. A method for utilizing the waste heat of an internal combustion engine (2) for the device as claimed in claim 1, characterized in that the working medium is conducted past the expansion machine (10) through the bypass connection (14) in a manner controlled by the bypass pressure regulating valve (16).

6. The method as claimed in claim 5, characterized in that, in the event of reduced power of the internal combustion engine (2), working medium flows through the bypass connection (14) as a result of the opening of the bypass pressure regulating valve (16), and the power output of the expansion machine (10) is thus reduced.

7. The method as claimed in claim 5, characterized in that pressure oscillations in at least one of the heat exchanger (8) and the adjoining lines (24, 26) are reduced by means of a cyclic opening of the bypass pressure regulating valve (16).

8. The method as claimed in claim 5, characterized in that, at temperatures below the freezing point of the working medium, before the start-up of the expansion machine (10), working medium heated in the heat exchanger (8) is conducted through a housing (33) of the expansion machine (10) or is conducted past in the vicinity of the housing (33) of the expansion machine (10).

9. The method as claimed in claim 5, characterized in that—before the start-up of the expansion machine (10), the bypass pressure regulating valve (16) is open, and heat is dissipated from the heat exchanger (8) via the bypass connection (14) to a cooling circuit (20) of the internal combustion engine (2).

10. The method as claimed in claim 5, characterized in that the bypass pressure regulating valve (16) is open in the event of excessively low superheating of the steam.

11. The method as claimed in claim 5, characterized in that at least one of the bypass pressure regulating valve (16) and the pressure limiting valve (32) is open in the event of more than a predefined pressure.

12. A device for utilizing the waste heat of an internal combustion engine (2), having a line circuit (4) in which are arranged a feed pump (6), at least one heat exchanger (8), an expansion machine (10), and a condenser (12), wherein a working medium circulates in the line circuit (4), characterized in that a bypass connection (14) is connected in parallel with the expansion machine (10), in such a way that, as a function of an operating situation of the internal combustion engine (2), the expansion machine (10) is coupled into or decoupled from the line circuit (4) for waste-heat utilization, wherein at least one line of the bypass connection (14) runs through a housing (33) of the expansion machine (10).

13. The device as claimed in claim 12, further comprising at least one of a pressure regulating valve and a pressure relief valve for adjusting the pressure in a line (24) between the feed pump (6) and heat exchanger (8).

14. A method for utilizing the waste heat of an internal combustion engine (2) for the device as claimed in claim 12, characterized in that the working medium is conducted past the expansion machine (10) through the bypass connection (14) in a manner controlled by a bypass pressure regulating valve (16).

15. The device as claimed in claim 12, characterized in that the condenser (12) is connected to a cooling circuit (20) of the internal combustion engine.

16. The method as claimed in claim 14, characterized in that, in the event of reduced power of the internal combustion engine (2), working medium flows through the bypass connection (14) as a result of the opening of the bypass pressure regulating valve (16), and the power output of the expansion machine (10) is thus reduced.

17. The method as claimed in claim 14, characterized in that pressure oscillations in at least one of the heat exchanger (8) and the adjoining lines (24, 26) are reduced by means of a cyclic opening of the bypass pressure regulating valve (16).

18. The method as claimed in claim 14, characterized in that, at temperatures below the freezing point of the working medium, before the start-up of the expansion machine (10), working medium heated in the heat exchanger (8) is conducted through a housing (33) of the expansion machine (10) or is conducted past in the vicinity of the housing (33) of the expansion machine (10).

19. The method as claimed in claim 14, characterized in that—before the start-up of the expansion machine (10), the bypass pressure regulating valve (16) is open, and heat is dissipated from the heat exchanger (8) via the bypass connection (14) to a cooling circuit (20) of the internal combustion engine (2).

20. The method as claimed in claim 14, characterized in that the bypass pressure regulating valve (16) is open in the event of excessively low superheating of the steam.

21. The method as claimed in claim 14, characterized in that at least one of the bypass pressure regulating valve (16) and the pressure limiting valve (32) is open in the event of more than a predefined pressure.

* * * * *